US005211215A

United States Patent [19]

Sommer

[11] Patent Number: 5,211,215

[45] Date of Patent: May 18, 1993

[54] PROCESS FOR NEUTRALIZING REGENERATED SAND

[76] Inventor: Hermann W. Sommer, Reginawerk 4, D-8089 Emmering, Fed. Rep. of Germany

[21] Appl. No.: 856,872

[22] Filed: Mar. 24, 1992

Related U.S. Application Data

[63] Continuation of Ser. No. 524,591, May 17, 1990, abandoned.

[30] Foreign Application Priority Data

Feb. 14, 1990 [DE] Fed. Rep. of Germany ..... 4004553

[51] Int. Cl.[5] ..... B08B 7/04; B22C 5/00; B22C 5/18

[52] U.S. Cl. ..... 164/5; 134/2; 134/3

[58] Field of Search ..... 164/5; 241/DIG. 10; 134/2, 3

[56] References Cited

U.S. PATENT DOCUMENTS

| | | | |
|---|---|---|---|
| 3,871,438 | 3/1975 | Vissers et al. | 164/5 |
| 4,401,638 | 8/1983 | Caballero et al. | 423/340 |
| 4,449,566 | 5/1984 | Filipovitch et al. | 164/5 |
| 4,685,973 | 8/1987 | Ashton | 164/5 X |
| 4,952,246 | 8/1990 | Seeley | 164/5 X |
| 4,960,162 | 10/1990 | Millager | 164/5 |

FOREIGN PATENT DOCUMENTS

| | | | |
|---|---|---|---|
| 0130808 | 1/1985 | European Pat. Off. . | |
| 0343272 | 11/1989 | European Pat. Off. | 164/5 |
| 2233111 | 1/1974 | Fed. Rep. of Germany . | |
| 2554405 | 6/1976 | Fed. Rep. of Germany . | |
| 2656672 | 2/1978 | Fed. Rep. of Germany . | |
| 51-22621 | 2/1976 | Japan | 164/5 |
| 53-78925 | 7/1978 | Japan | 164/5 |
| 56-40657 | 9/1981 | Japan | 164/5 |
| 1245395 | 7/1986 | U.S.S.R. | 164/5 |
| 2018650A | 10/1979 | United Kingdom . | |

OTHER PUBLICATIONS

Geremia, J. J., "New Sand from Old: Thermal Reclamation . . . " 85 *AFS Transactions,* pp. 123–128 (Am. Found. Soc.), 1977.

Stevenson, M., "The reclamation of sands bonded with alkaline Phenolic Resins," *The British Foundryman,* pp. 382–383, Oct. 1986.

VDG-Merkblatt, No. R 93 (Verein Deutscher Giessereifachleute), Nov. 1988 (in German).

Weller, Edwin, "Möglichkeiten und Grenzen . . . ". *Zeitschrift Giesserei* 76, No. 10/11, May 15, 1989 (German) pp. 350–358.

Grothe, Hans, *Lueger Lexikon der Technik,* 1963, pp. 214–215.

Jander, G. and Wendt, H., *Introduction to Inorganic Chemical Practice,* p. 306 (3d Ed. 1954) (in German).

*Primary Examiner*—J. Reed Batten, Jr.
*Attorney, Agent, or Firm*—Edwin D. Schindler

[57] ABSTRACT

Sand containing clay binder after regeneration is neutralized with $NH_4OH$ as a base or sulfuric acid or hydrofluoric acid depending on its pH-value determined after regeneration by a measuring procedure, so that it subsequently has a pH-value between 6 and 8.

11 Claims, 1 Drawing Sheet

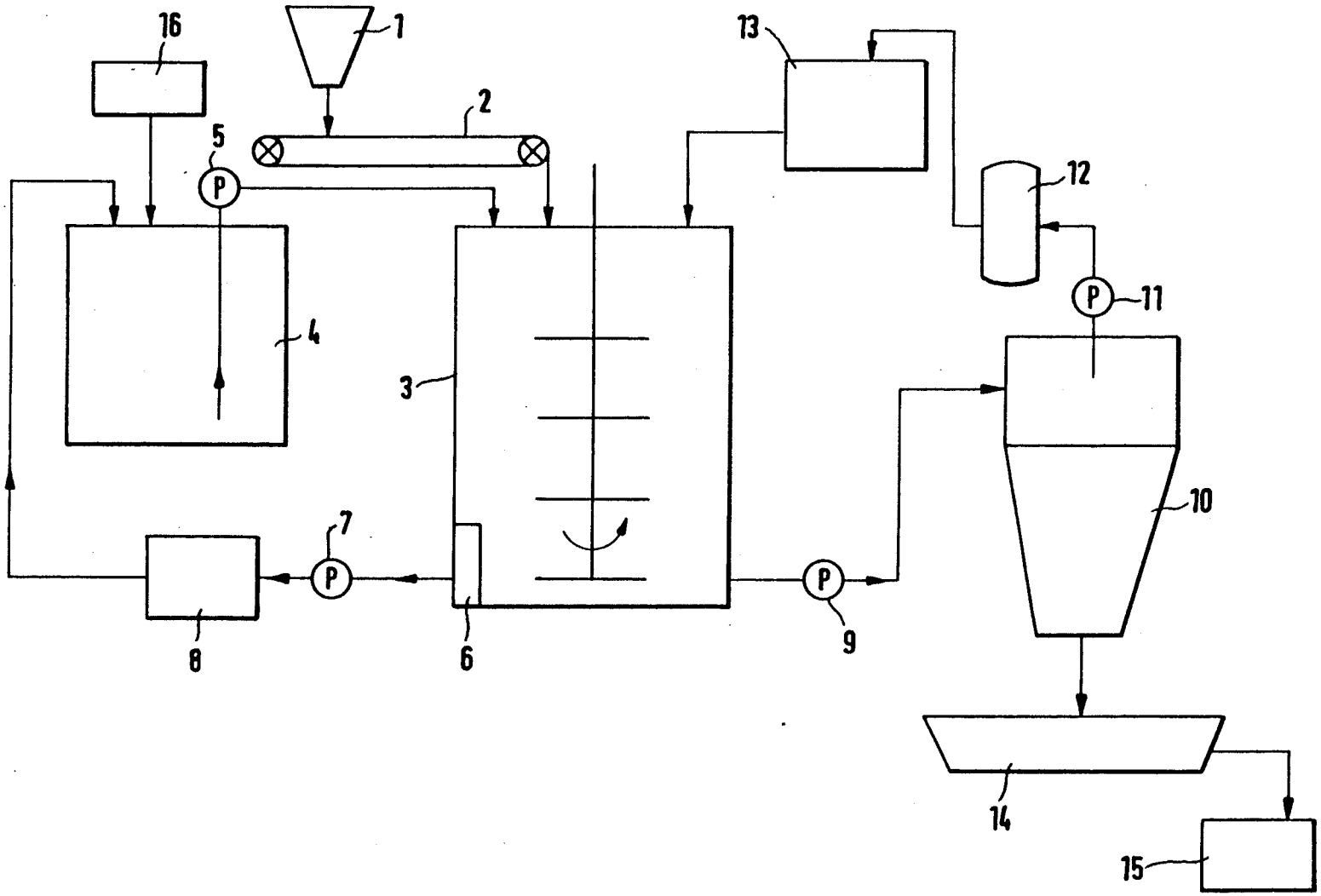
1
2
3
4
5
6
7
8
9
10
11
12
13
14
15
16
P
P
P
P
P

PROCESS FOR NEUTRALIZING REGENERATED SAND

This application is a continuation of application Ser. No. 07/524,591, filed May 17, 1990, now abandoned.

BACKGROUND OF THE INVENTION

The invention relates to a method for reconditioning foundry sand.

The wet, mechanical, thermal or combined regeneration of foundry sand such as quartz sand, olivine, zircon, chromite sand and the like having organic or inorganic binders is known. The goal of such regeneration processes is to provide a reconditioned sand which can be re-used instead of or as new sand. At the same time, substances in the foundry sand hazardous to the environment are to be eliminated by regeneration. Sand bound organically usually only needs to be regenerated thermally, if it does not contain basic, acidic or other disturbing components, which do not combust or vaporize.

Mono-sand or mixed sand bound inorganically, in particular sand originally treated with bentonite must be thermally and mechanically regenerated to produce a sand which can be re-used.

A disadvantage of these known methods, for example for organic binder systems with basic or acidic components which are difficult or impossible to eliminate and in particular for mono-sand or mixed sand with inorganic binders, is that the regenerate sand has properties which deviate from new sand, for example the pH-value, the electrical conductivity, the degree of oölithization, the sludge content and the like. The properties of such regenerate sand are more or less disadvantageous especially for reuse in making cores. The poorer properties of such regenerate sand apply particularly in its use as core sand with a synthetic resin binder and cause reduced rigidity, reduced processing time of the sand mixtures, increased consumption of binder and the like.

SUMMARY OF THE INVENTION

The object of the present invention is to provide a process of the above described type, with which thermally and/or mechanically regenerated sand can be treated so that subsequently it is like new sand or similar to it.

This object is solved according to the invention in that sand containing an organic binder after thermal regeneration or sand containing inorganic binder after a thermal and mechanical regeneration is neutralized with a suited base or acid depending on its pH-value determined after regeneration by a measuring procedure, for example by titration, so that subsequently it has a pH-value between 6 and 8.

Preferably, the pH-value of the sand lies between 6.8 and 7.5 after neutralization. For carrying out the neutralization procedure, when neutralization via a base is appropriate, preferably, $NH_4OH$ is used as a base. When neutralization using an acid is appropriate, preferably, either sulfuric acid or hydrofluoric acid is utilized.

When neutralization is carried out with an acid, preferably, it is carried out with concentrated sulfuric acid in an amount of 3 to 50 ml per kg sand; the sulfuric acid being added to the sand which is basic after regeneration. Most preferably, 8 to 12 ml per kg sand of concentrated sulfuric acid is used for such a neutralization.

When neutralization is carried out with a base, preferably, it is carried out with 25% $NH_4OH$ per kg sand in an amount of 3 to 40 ml per kg sand; the $NH_4OH$ being added to the sand which is acidic after regeneration. Most preferably, 12 ml of 25% $NH_4OH$ is used for such a neutralization.

The essence of the invention is then to additionally wet-neutralize and purify the sand grains such as quartz grains for example originally treated with organic and/or inorganic binders (bentonite) after a thermal treatment and a subsequent mechanical purification, in particular to bring its pH-value and its electrical conductivity to the corresponding values of new sand.

The organic binder is extensively combusted or the inorganic binder, for example clay or bentonite, is dead-burned by the thermal and mechanical treatment and substantially extracted and separated from the sand grains by the mechanical purification. According to the invention, the regenerate sand is subsequently neutralized in the wet state in containers and purified. The mixture is stirred or turned in the treatment vessel to support and accelerate the process.

The necessary amounts of neutralization additives can be advantageously determined by titration of 50 to 100 g of a sand sample, namely when the sand is in its thermal or possibly its mechanical regeneration state.

Experiments have shown surprisingly that a certain turbidity of the aqueous solution arises when adding a suitable acid as the neutralizer to regenerate sand which was bound inorganically. Apparently a slight separation of dirt or sludge or binder still adhering to the sand grains is caused by the neutralization. Thus a possible electrostatic binding and adhesion of the grains is also eliminated.

After the neutralization and optionally a washing and subsequent drying, the treated sand when observed under the microscope already has a clearly cleaner appearance than before and has properties which are the same or similar to new sand as is shown in the following examples I and II.

Example I
Quartz sand regenerate: AFS 60.3

| Property | Initial regenerate sand | Neutralization with 10 ml conc. $H_2SO_4$ per kg | Comparable new sand |
|---|---|---|---|
| pH-value | 9.6 | 7.4 | ca. 7.0 |
| Electrical conductivity in μS/cm | 172 | 4 | ca. 0 |
| Red heat loss (%) | 0.17 | 0.14 | ca. 0 |
| Sludge content % | 1.04 | 0.34 | ca. 0.3 |
| Degree of oölithization | 0.93 | 0.79 | ca. 0 |

Example II
Quartz sand regenerate: AFS 45

| Property | Initial regenerate sand | Neutralization with 12 ml $NH_4OH$ (25%) per kg sand |
|---|---|---|
| pH-value | 3.6 | 7.2 |
| Electrical conductivity in μS/cm | 189 | 12 |

BRIEF DESCRIPTION OF THE DRAWING

A neutralization of regenerated sand is illustrated in the attached drawing.

DETAILED DESCRIPTION OF THE PREFERRED EMBODIMENT

The sand already regenerated is fed to a neutralization vessel 3 from a sand supply 1 over a belt weigher for adjusting the weight per charge. Along with the supply of sand, a neutralization solution is pumped out of a storage container 4 by a pump 5 into the neutralization vessel 3 which is controlled by a fill level display (not shown). A stirring or turning of the material takes place in the vessel 3 by schematically illustrated stirring means during the filling process and during neutralization. After neutralization, the solution is drawn through a filter plate 6, a pump 7 and a filter 8 and fed back to the storage container 4. A refreshing of the used neutralization solution with wash or fresh water and the addition of new acid or base takes place by means of a container 16. After neutralization, a washing and purification of the neutralized regenerate takes place by introducing a washing solution from the storage container 13 into the vessel 3 when the stirring process is continued. The sand-wash water mixture is then pumped out of the vessel 3 by a pump 9 into a cyclone 10. The sand and sludge-containing water separate in the cyclone 10. The sludge water is purified in a filter 12 and fed back to the storage container 13 by a pump 11. Fresh water is added here to the used washing water. The separated, purified and neutralized sand from the cyclone 10 is dried by means of a swing drier 14 and then transported to a storage bunker 15.

The neutralization and washing or purification take place alternatively in two respectively closed circulation systems. To adjust the neutrality of the washing solution, bases can also be added for example when neutralizing with an acid or also vice versa. The belt weigher can also fill several neutralization vessels by means of a distributor belt, where also several cyclones can be employed.

The neutralization and purification processes are performed in closed cycles with the least possible amount of water consumption for environmental reasons. The neutralization solution after the completed reaction is drawn out of the vessel together with the extracted sludge fraction and subsequently passed through a filter to separate the sludge material. When necessary, the filtered and used neutralization solution is refreshed with new acid or base and with fresh water or wash water and is always fed back in the cyclic process for the next treatment, for example by means of an intermediate container.

A further example is shown in the following of a mixed sand bound inorganically, where the initial old sand is thermally and mechanically prepared to give regenerate sand and it is subsequently neutralized and purified.

A strength test is made on particularly sensitive cold-box core sand mixtures at various stages of treatment compared to new sand.

Example III

| Bentonite old sand | Therm.-mech. regen. sand from I | Neutral. with 10 ml conc. $H_2SO_4$ per kg sand from I |
|---|---|---|

-continued

Example III

| Mesh analysis | I % | II % | III % |
|---|---|---|---|
| 0.71 mm | 0.2 | 0 | 0.1 |
| 0.5 mm | 0.5 | 0.7 | 0.9 |
| 0.355 mm | 3.6 | 6.1 | 5.7 |
| 0.25 mm | 25.1 | 22.3 | 21.5 |
| 0.18 mm | 52.8 | 48.0 | 50.2 |
| 0.125 mm | 14.2 | 21.0 | 20.0 |
| 0.09 mm | 3.3 | 1.8 | 1.5 |
| 0.063 mm | 0.3 | 0.1 | 0.1 |
| 0.02 mm | 0 | 0 | 0 |
| 20.02 mm | 0 | 0 | 0 |
| pH-value | 9.8 | 9.7 | 7.1 |
| Electr. conductivity in μS/cm | 976 | 165 | 3 |
| Sludge % | 8.26 | 0.93 | 0.32 |
| Red heat loss % | 2.57 | 0.17 | 0.14 |
| Oölith. degree | 2.3 | 0.89 | 0.77 |

Comparison of flexural strength in $N/cm^2$ on cold-box sand samples:

sand mixture:
30% new sand, AFS about 60
70% therm.-mech. regenerate
0.8% synthetic resin 352 T 14
0.8% synthetic resin 652 TEA 700

| Test time | Sand II | Sand III | 100 new sand |
|---|---|---|---|
| | 150 | 260 | 230 |
| ½ h | 185 | 390 | 340 |
| 1 h | 190 | 420 | 410 |
| 2 h | 192 | 440 | 420 |
| 24 h | 225 | 450 | 460 |

I claim:

1. A process for neutralizing regenerated sand, comprising the steps of:

measuring the pH of regenerated sand, the regenerated sand containing a clay binder; and, neutralizing the regenerated sand with a neutralizing agent being either an acid or a base and selected from the group consisting of sulfuric acid, hydrofluoric acid and $NH_4OH$, said neutralizing agent being said acid if the pH of the regenerated sand, as determined during said measuring step, is basic and said neutralizing agent being said base if the pH of the regenerated sand, as determined during said measuring step is acidic, the regenerated sand having a pH-value of between 6 and 8 following said neutralizing step.

2. The process for neutralizing regenerated sand according to claim 1, wherein the pH-value of the regenerated sand following said neutralizing step is between 6.8 and 7.5.

3. The process for neutralizing regenerated sand according to claim 1, further comprising the steps of:

purifying the regenerated sand in a wet purification procedure following said neutralizing step; and, drying the regenerated sand following said purifying step.

4. The process for neutralizing regenerated sand according to claim 3, wherein said neutralizing step and said purifying step are performed in a closed circulation system.

5. The process for neutralizing regenerated sand according to claim 1, wherein said neutralizing step is carried out with concentrated sulfuric acid in an amount of 3 to 50 ml per kg of said regenerated sand.

6. The process for neutralizing regenerated sand according to claim 5, wherein said neutralizing step is carried out with concentrated sulfuric acid in an amount of 8 to 12 ml per kg of said regenerated sand.

7. The process for neutralizing regenerated sand according to claim 6, wherein said neutralizing step is carried out with a neutralizing solution which is purified by filtration, refreshed with washing water and reused in said neutralizing step.

8. The process for neutralizing regenerated sand according to claim 1, wherein said neutralizing step is carried out with 25% $NH_4OH$ in an amount of 3 to 40 ml per kg of said regenerated sand.

9. The process for neutralizing regenerated sand according to claim 8, wherein said neutralizing step is carried out with 25% $NH_4OH$ in an amount of 12 ml per kg of said regenerated sand.

10. The process for neutralizing regenerated sand according to claim 1, wherein said neutralizing step is carried out with a neutralizing solution which is purified by filtration, refreshed with washing water and reused in said neutralizing step.

11. The process for neutralizing regenerated sand according to claim 1, wherein said measuring step is carried out by titration.

* * * * *